US010916413B2

(12) United States Patent
Sheils et al.

(10) Patent No.: US 10,916,413 B2
(45) Date of Patent: Feb. 9, 2021

(54) ELECTRON MULTIPLIERS

(71) Applicant: ADAPTAS SOLUTIONS PTY LTD, Clyde (AU)

(72) Inventors: Wayne Sheils, Clyde (AU); Kevin Hunter, Clyde (AU)

(73) Assignee: ADAPTAS SOLUTIONS PTY LTD, Clyde (AU)

( * ) Notice: Subject to any disclaimer, the term of this patent is extended or adjusted under 35 U.S.C. 154(b) by 113 days.

(21) Appl. No.: 16/308,193

(22) PCT Filed: Jun. 8, 2017

(86) PCT No.: PCT/AU2017/050570
§ 371 (c)(1),
(2) Date: Dec. 7, 2018

(87) PCT Pub. No.: WO2017/210741
PCT Pub. Date: Dec. 14, 2017

(65) Prior Publication Data

US 2019/0259590 A1 Aug. 22, 2019

Related U.S. Application Data

(60) Provisional application No. 62/347,713, filed on Jun. 9, 2016.

(51) Int. Cl.
*H01J 43/02* (2006.01)
*H01J 43/18* (2006.01)
*H01J 43/04* (2006.01)

(52) U.S. Cl.
CPC ..... *H01J 43/025* (2013.01); *H01J 43/04* (2013.01); *H01J 43/18* (2013.01)

(58) Field of Classification Search
CPC ..... H01J 43/025; H01J 43/04; H01J 43/18
See application file for complete search history.

(56) References Cited

U.S. PATENT DOCUMENTS 3,997,779 A 12/1976 Rabl
2007/0012867 A1* 1/2007 Wolters ..... H03F 3/08 250/214 R (Continued)

FOREIGN PATENT DOCUMENTS

AU 3623784 A 6/1985
GB 2190785 11/1987
WO 2002086944 A1 10/2002

OTHER PUBLICATIONS

International Search Report dated Sep. 4, 2017 for corresponding International Patent Application PCT/AU2017/050570, filed on Jun. 8, 2017.

(Continued)

*Primary Examiner* — Georgia Y Epps
*Assistant Examiner* — Don J Williams
(74) *Attorney, Agent, or Firm* — David D. Brush; Westman, Champlin & Koehler, P.A.

(57) ABSTRACT

An apparatus for amplifying an electron signal caused by the impact of a particle with an electron emissive surface. The apparatus includes: a first electron emissive surface configured to receive an input particle and thereby emit one or more secondary electrons, a series of second and subsequent electron emissive surfaces configured to form an amplified electron signal from the one or more secondary electrons emitted by the first electron emissive surface, and one or more power supplies configured to apply bias voltage(s) to one or more of the emissive surfaces. The bias voltage(s) is sufficient to form the amplified electron signal. The apparatus is configured such that the terminal electron emissive surface(s) of the series of second and subsequent electron emissive surfaces draw a higher electrical current than that of the remainder electron emissive surface(s). The apparatus (Continued)

may be used as part of detector in a mass spectrometer, for example.

15 Claims, 12 Drawing Sheets

(56) References Cited

U.S. PATENT DOCUMENTS

| | | | |
|---|---|---|---|
| 2009/0057548 | A1 | 3/2009 | Hidalgo et al. |
| 2015/0187550 | A1 | 7/2015 | Hirano |

OTHER PUBLICATIONS

Written Opinion of the International Searching Authority dated Sep. 4, 2017, for corresponding International Patent Application PCT/AU2017/050570 filed on Jun. 8, 2017.

* cited by examiner

ELECTRON MULTIPLIERS

CROSS-REFERENCE TO RELATED APPLICATIONS

This Application is a Section 371 National Stage Application of International Application No. PCT/AU2017/050570, filed Jun. 8, 2017, published as WO 2017/210741 A1 on Dec. 14, 2017, in English, which is based on and claims the benefit of U.S. Provisional Patent Application No. 62/347,713, filed Jun. 9, 2016; the contents of which are hereby incorporated by reference in their entireties.

FIELD OF THE INVENTION

The present invention relates generally to components of scientific analytical equipment. More particularly, the invention relates to apparatus and methods for achieving high linear output currents from an electron multiplier.

BACKGROUND TO THE INVENTION

In many scientific applications, it is necessary to amplify an electron signal. For example, in a mass spectrometer the analyte is ionized to form a range of charged particles (ions). The resultant ions are then separated according to their mass-to-charge ratio, typically by acceleration and exposure to an electric or magnetic field. The separated signal ions impact on an ion detector surface to generate one or more secondary electrons. Results are displayed as a spectrum of the relative abundance of detected ions as a function of the mass-to-charge ratio.

In other applications the particle to be detected may not be an ion, and may be a neutral atom, a neutral molecule, or an electron. In any event, a detector surface is still provided upon which the particles impact.

The secondary electrons resulting from the impact of an input particle on the impact surface of a detector are typically amplified by an electron multiplier. Electron multipliers generally operate by way of secondary electron emission whereby the impact of a single or multiple particles on the multiplier impact surface causes single or (preferably) multiple electrons associated with atoms of the impact surface to be released.

One type of electron multiplier is known as a discrete-dynode electron multiplier. Such multipliers include a series of surfaces called dynodes, with each dynode in the series set to increasingly more positive voltage. Each dynode is capable of emitting one or more electrons upon impact from secondary electrons emitted from previous dynodes. Configuration of a typical prior art discrete dynode electron multiplier is shown in FIG. 1A. When a particle strikes the first dynode D1 it can emit a secondary electron, this secondary electron being then directed onto the next dynode D2, at a more positive voltage, where it strikes the surface with sufficient energy to cause the emission of one or more secondary electrons (the signal electron or signal current). If more electrons are emitted than are incident this dynode is said to have an amplification of the electron current. This process is repeated at each successive dynode in the multiplier to produce an overall very large amplification, or gain.

In a discrete-dynode electron multiplier, the dynode surfaces may take the form of a series of discrete metal electrodes where the voltage at each dynode is set by a voltage divider chain used to distribute voltage from a high voltage power supply to the dynodes. (this seems redundant)

This divider chain is usually constructed as a series of resistors shown as $R_1$ to $R_N$ in FIG. 1A.

Another type of electron multiplier operates using a single continuous dynode, as distinct from a number of discrete dynodes. In these versions, the resistive material of the continuous dynode itself is used as the voltage divider to distribute voltage along the length of the emissive surface, as shown in FIG. 1B.

The high voltage power supply that provides voltage to the voltage divider chain may be configured such that it is connected to ground or a reference voltage at the anode end of the circuit, as shown in FIG. 2A, or alternatively it may be connected to ground or a reference voltage at the input end of the circuit as shown in FIG. 2B.

A problem in the art is that the voltage applied to a dynode may be perturbed from its optimum operating value when the dynode is subject to high output currents. To allow the electron multiplier to operate linearly at very high output signal currents the resistance of the resistors used in the voltage divider chain are typically reduced to a low value to make the voltages applied to each dynode less susceptible to perturbations caused by the current drawn from the dynodes at high output currents. Another method commonly used to stabilise the dynode voltages and the gain at higher output currents is to use zener diodes between the dynodes.

There are significant limitations with both of these methods for achieving high linear output currents from an electron multiplier. In the case of using zener diodes, the temperature dependence of the zener voltage can be detrimental to the performance of the detector, and electrical noise generated by the zener diodes can interfere with low level signal measurements and may need to be suppressed. Also the current flowing through the zener diode(s) and to the associated dynodes is limited by the resistors in series with the zener diodes, placing an upper limit on the detectors output signal current. In the case of using a low resistance voltage divider to increase the bleed current (the current in the voltage divider chain), the heat generated in the electron multiplier by the power dissipated across the resistors of the resistive voltage divider can be significant and cause elevated background noise. Also, this method requires the use of an expensive and relatively high power high voltage power supply.

There is a clear need in the art for improved, or at least alternative means for achieving high linear output currents from an electron multiplier. It is an aspect of the present invention to provide improved apparatus and methods, or to at least provide an alternative to prior art means.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In a first aspect, but not necessarily the broadest aspect, the present invention provides an apparatus for amplifying an electron signal caused by the impact of a particle with an electron emissive surface, the apparatus comprising: a first electron emissive surface configured to receive an input particle and thereby emit one or more secondary electrons, a series of second and subsequent electron emissive surfaces configured to form an amplified electron signal from the one or more secondary electrons emitted by the first electron emissive surface, and one or more power supplies configured to apply bias voltage(s) to one or more of the emissive surfaces, the bias voltage(s) being sufficient to form the amplified electron signal, wherein the apparatus is configured such that the terminal electron emissive surface(s) of the series of second and subsequent electron emissive surfaces draw a higher electrical current than that of the remainder electron emissive surface(s).

In one embodiment, the apparatus comprises a first power supply and at least a second power supply, each of which is configured to independently apply a bias voltage to (i) a different electron emissive surface, and/or (ii) a different group of electron emissive surfaces.

In one embodiment of the apparatus, at least two of the emissive surfaces are discrete emissive surfaces.

In one embodiment of the apparatus, each of the emissive surfaces are discrete emissive surfaces.

In one embodiment of the apparatus, the discrete emissive surface are discrete dynodes.

In one embodiment of the apparatus, at least one of the emissive surfaces is a continuous emissive surface.

In one embodiment of the apparatus, the continuous emissive surface is a continuous dynode.

In one embodiment of the apparatus, the second power supply is configured to apply a bias voltage to only the terminal 12, 11, 10, 9, 8, 7, 6, 5, 4, 3, 2 or 1 discrete emissive surfaces, and the first power supply is configured to apply a bias voltage to only the remainder discrete emissive surfaces.

In one embodiment of the apparatus, the second power supply is configured to apply a bias voltage to the terminal about 50%, 45%, 40%, 35%, 30%, 25%, 20%, 15%, 10%, or 5% of the emissive surface, and the first power supply is configured to apply a bias voltage to a remainder portion of the emissive surface.

In one embodiment, the apparatus further comprises a third, fourth, or fifth power supply, wherein each of the first, second, third, fourth or fifth power supply is configured to apply a bias voltage to a different electron emissive surface, or group of different emissive surfaces.

In one embodiment of the apparatus, the bias voltages are applied according to the following: the first most positive (or least negative) bias voltage is applied to the most terminal emissive surface or group of emissive surfaces, the second most positive (or least negative) bias voltage is applied to the second most terminal emissive surface or group of emissive surfaces, the third most positive (or least negative) bias voltage (where present) is applied to the third most terminal emissive surface or group of emissive surfaces (where present), the fourth most positive (or least negative) bias voltage (where present) is applied to the fourth most terminal emissive surface or group of emissive surfaces (where present), and the fifth most positive (or least negative) bias voltage (where present) is applied to the fifth most terminal emissive surface or group of emissive surfaces (where present).

In one embodiment of the apparatus, each group of dynodes powered by each of the power supplies has a bleed current (being the current in the voltage divider chain), and the bleed current of the electrical circuit powered by the second power supply is higher than the bleed current of the electrical circuit powered by the first power supply.

In one embodiment of the apparatus, the bleed currents are according to the following: the first highest bleed current is in the circuit comprising the most terminal emissive surface or group of emissive surfaces, the second highest bleed current is in the circuit comprising the second most terminal emissive surface or group of emissive surfaces, the third highest bleed current (where present) is in the circuit comprising the third most terminal emissive surface or group of emissive surfaces (where present), the fourth highest bleed current (where present) is in the circuit comprising the fourth most terminal emissive surface or group of emissive surfaces (where present), and the fifth highest bleed current (where present) is in the circuit comprising the fifth most terminal emissive surface or group of emissive surfaces (where present).

In one embodiment of the apparatus, the second power supply, or any one or more of the third, fourth or fifth power supplies (where present) is/are electrically connected in the series of electron emissive surfaces such that the gain of the apparatus is more linear, or linear over a greater operational range, as compared with an identical apparatus having at least one less power supply.

In a second aspect, the present invention provides a method for amplifying an electron signal caused by the impact of a particle with an electron emissive surface, the method comprising the steps of: providing the apparatus as described herein, causing or allowing a particle to impact the first electron emissive surface, and applying a bias voltage(s) to one or more of the emissive surfaces, the bias voltage(s) being sufficient to form the amplified electron signal.

In a third aspect, the present invention comprises a method for amplifying an electron signal caused by the impact of a particle with an electron emissive surface, the method comprising the steps of: providing the apparatus as described herein, causing or allowing a particle to impact the first electron emissive surface, and applying the bias voltage of each power supply independently to (i) different electron emissive surfaces, and/or (ii) different groups of electron emissive surfaces, the difference(s) in bias voltages being sufficient such that the terminal electron emissive surface(s) of the series of second and subsequent electron emissive surfaces draw a higher electrical current than (a) that of the remainder electron emissive surface(s) of the series of second and subsequent electron emissive surfaces, and/or (b) the first emissive surface.

DETAILED DESCRIPTION OF THE INVENTION INCLUDING PREFERRED EMBODIMENTS

Figure 1A:
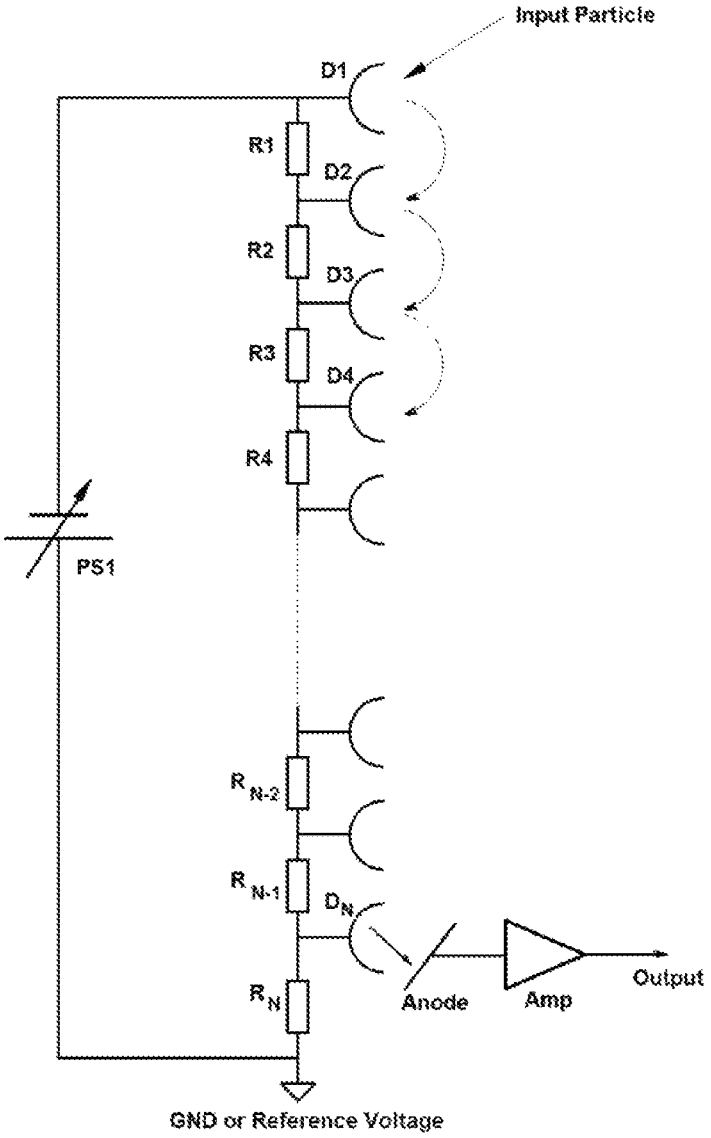
FIG. 1A (prior art)
FIG. 1A is a schematic diagram of a prior art discrete-dynode electron multiplier. D1, D2 . . . refer to individual dynodes, R refers to a resistor, PS refers to a power supply, the curved arrows show the path of secondary electron for the first several dynodes.
Figure 1B:
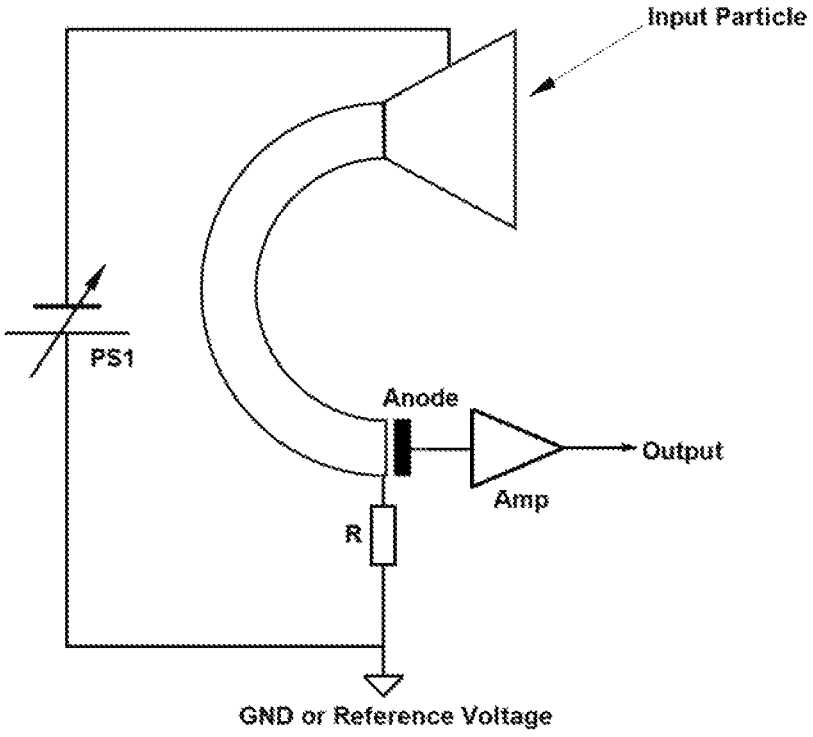
FIG. 1B (prior art)
FIG. 1B is a schematic diagram of a prior art continuous-dynode electron multiplier. R refers to a resistor, PS refers to a power supply.
Figure 2A:
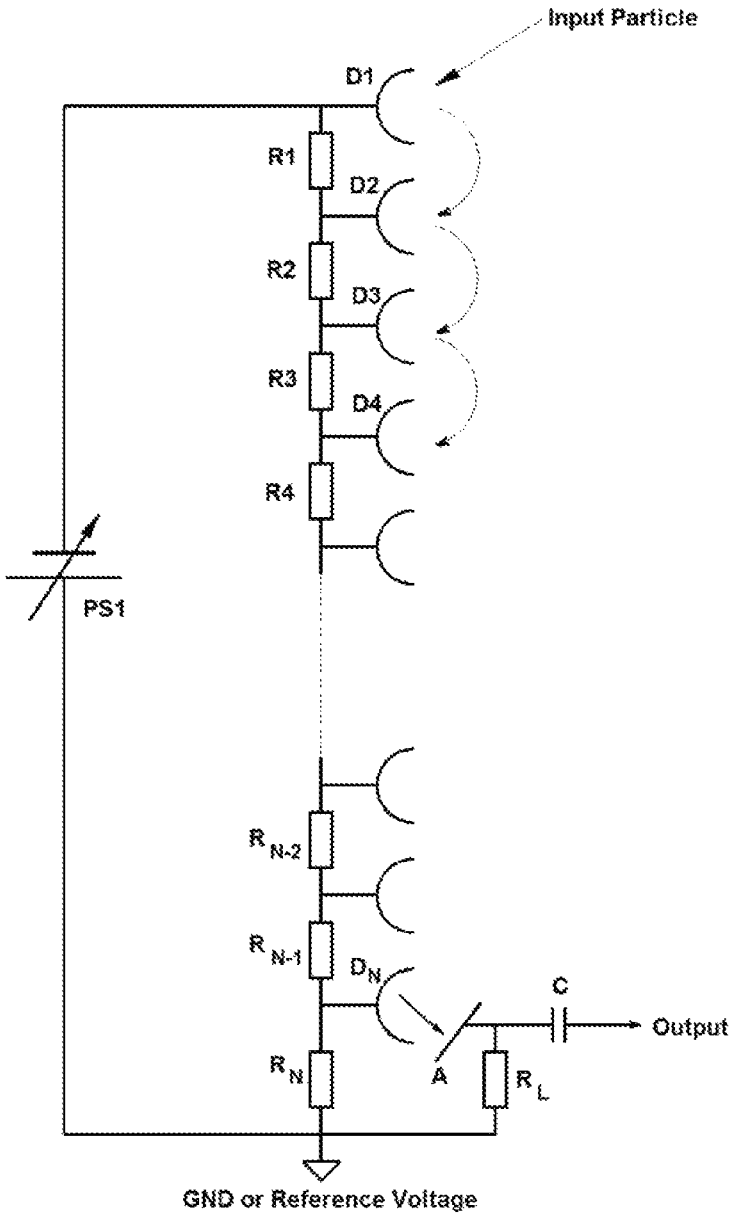
FIG. 2A (prior art)
FIG. 2A is a schematic diagram of a prior art discrete-dynode electron multiplier. D1, D2 . . . refer to individual dynodes, R refers to a resistor, PS refers to a power supply, the curved arrows show the path of secondary electron for the first several dynodes. This prior art apparatus provides an alternate method of signal extraction using a load resistor and an isolating capacitor.
Figure 2B:
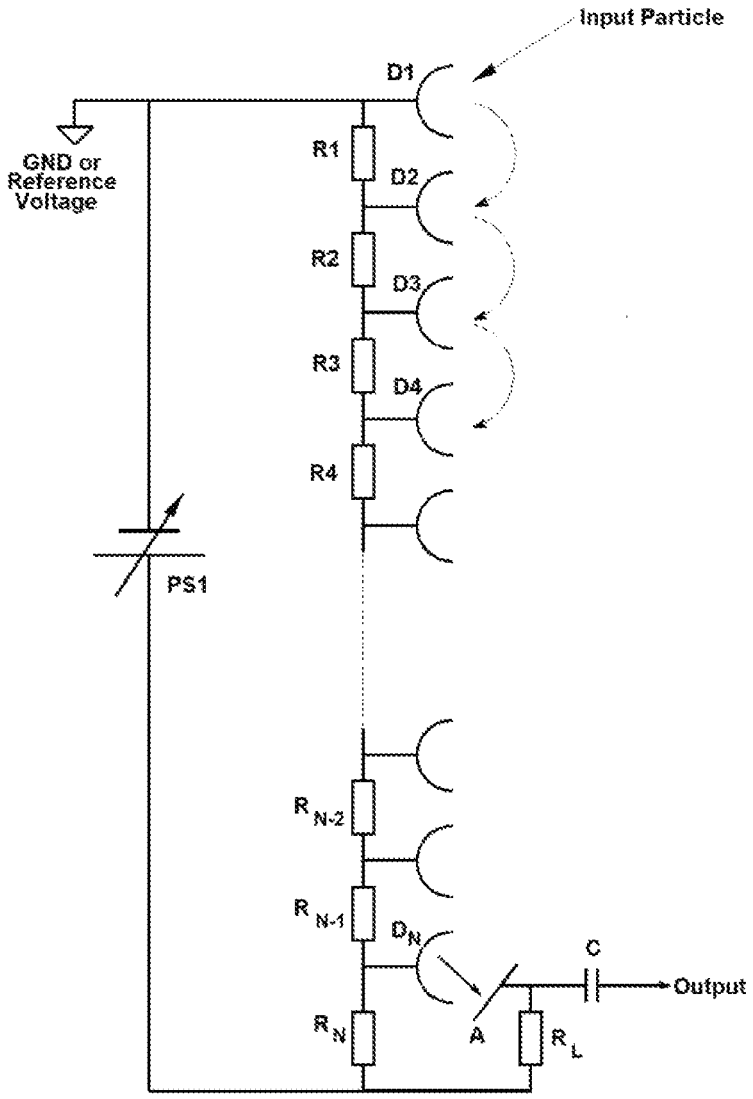
FIG. 2B (prior art)
FIG. 2B is a schematic diagram of a prior art discrete-dynode electron multiplier. D1, D2 . . . refer to individual dynodes, R refers to a resistor, PS refers to a power supply, the curved arrows show the path of secondary electron for the first several dynodes. This prior art apparatus provides an alternate method of referencing the high voltage with the input end at ground or a reference voltage.

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

The present invention is predicated at least in part on Applicants finding that improvement in the amplification of an electron signal is provided whereby a relatively high electrical current flows between the terminal dynodes in a series of dynodes is provided, and a relatively low current flows through the remainder dynodes. By this arrangement, the power requirements of a high voltage power supply which powers the dynodes remains relatively low, and the overall power dissipated by the apparatus is reduced. At least in some embodiments of the apparatus this may result in less voltage perturbation, and improvements in the linearity of the response of the apparatus to an input signal. Accordingly, in a first aspect the present invention provides Apparatus for amplifying an electron signal caused by the impact of a particle with an electron emissive surface, the apparatus comprising: a first electron emissive surface configured to receive an input particle and thereby emit one or more secondary electrons, a series of second and subsequent electron emissive surfaces configured to form an amplified electron signal from the one or more secondary electrons emitted by the first electron emissive surface, and one or more power supplies configured to apply bias voltage(s) to one or more of the emissive surfaces, the bias voltage(s) being sufficient to form the amplified electron signal, wherein the apparatus is configured such that the terminal electron emissive surface(s) of the series of second and subsequent electron emissive surfaces draw a higher electrical current than that of the remainder electron emissive surface(s).

As used herein, the term "emissive surface" is intended to include the surface of any material capable of emitting a secondary electron upon impact of a particle (a charged or uncharged atom, a charged or an uncharged molecule, a charged or an uncharged subatomic particle such as a neutron or a proton or an electron. The skilled person is entirely familiar with the materials, physical and function configurations of an emissive surface in this context, an exemplary type being that provided by a dynode.

As is conventional in an electron multiplier, a first electron emissive surface is provided which is configured to receive an input particle, and in response to the impact of the input particle emit one or multiple electrons. Where multiple electrons are emitted, an amplification of the input signal results.

As is also conventional, a series of second and subsequent electron emissive surfaces is provided. The function of these emissive surfaces is to amplify the electron(s) which are emitted from the first emissive surface. As will be appreciated, amplification occurs typically at each subsequent emissive surface of the series of emissive surfaces. Typically, the secondary electrons emitted by the final emissive surface are directed onto an anode surface, with the current formed in the anode feeding into a signal amplifier and subsequently an output device.

As will become apparent by reference to the preferred embodiments described infra, the present invention is operable in respect of discrete dynode electron multipliers and also continuous dynode electron multipliers. In that regard, the term "emissive surface" may be construed to mean a physically defined surface, but also a region of a surface which is not physically defined. With regard to the latter, a continuous dynode may be considered to comprise many emissive surfaces, and may be considered to comprise almost an infinite number of emissive surfaces.

However defined, the emissive surfaces of the present apparatus are divided at least into a terminal electron emissive surface and a remainder electron emissive surface. In a discrete dynode electron multiplier, a terminal electron emissive surface may be the final dynode in the series of dynodes (i.e. the dynode closest to the anode), or a group of dynodes including the final dynode. As an example of the latter case, where the apparatus has a total of 12 emissive surfaces (a first emissive surface and a further 11 second and subsequent emissive surfaces) then the terminal emissive surfaces may consist of the surfaces of the last 3 dynodes (i.e. dynodes 10, 11 and 12) in the series.

The remainder electron emissive surface(s) are surface(s) which are not terminal electron emissive surfaces (and including the first emissive surface). Considering the example immediately supra, the surfaces of dynodes 1 to 9 are the remainder emissive surfaces, with dynodes 10 to 12 being the terminal emissive surfaces.

In a continuous-dynode electron multiplier, the terminal electron surface may be considered the surface of a terminal length of the dynode. For example, the continuous dynode has a certain length, and the terminal electron emissive surface may be the final 10% portion of the length closest to the anode. In that circumstance the adjacent 90% of continuous dynode is the remainder emissive surface. The continuous-dynode may be a parallel plate or channel type.

Typically, all electron emissive surfaces of an apparatus are functionally considered either terminal or remainder, with no surface defined as neither. Furthermore, it is typical for a given surface to not be functionally considered as both a terminal and a remainder electron emissive surface.

While the present apparatus is not limited to any number of emissive surfaces, typical embodiments will have between about 12 and about 26 emissive surfaces.

The present apparatus is configured such that the terminal electron emissive surface(s) of the series of second and subsequent electron emissive surfaces draw a higher electrical current than (i) that of the remainder electron emissive surface(s) of the series of second and subsequent electron emissive surfaces, and/or (ii) the first emissive surface. The higher electrical current may be higher by a multiple of at least about $10^1$, $10^2$, $10^3$, $10^4$, $10^5$, $10^6$, $10^7$, $10^8$, or $10^9$. In many circumstances, a multiple of between about $10^5$ and $10^7$ is implemented. Means for configuring the apparatus such that the terminal electron emissive surface(s) of the series of second and subsequent electron emissive surfaces to draw a higher electrical current than that of the remainder electron emissive surface(s) of the series of second and subsequent electron emissive surfaces, may be any means deemed suitable by the skilled person having the advantage of the present specification.

Applicant proposes that in prior art electron multipliers, the single high voltage power supply typically used is insufficient under conditions of high output currents. Under these conditions, the current drawn by the several terminal diodes can be sufficiently large so as to cause a change in voltage applied to the dynode. This in turn leads to a departure of the apparatus from a linearity in response. Thus, under certain conditions, the proportionality of input signal to output signal departs from linearity leading to outputs which are not accurate. Applicant has discovered that by separately powering the terminal dynodes with a discrete power supply, these changes in voltages at high current draw are ameliorated or even overcome leading to a more linear output, or a linear output, or a more linear output over a greater operational range, or a linear output over a greater operational range.

A further advantage at least for some embodiments is that the main high voltage power supply (i.e. the power supply which applies voltage to the non-terminal electron emissive surface(s)) may be of a lower specification in terms of capabilities or a lower build quality given the need to power all emissive surfaces is removed. The single high voltage power supplies used in prior art electron multipliers are typically expensive components capable of high power outputs, and the avoidance of such components in the present apparatus provides clear economic advantage.

The use of one or more power supplies in addition to the main high voltage power supply provides the appropriate bias voltages on some of the electron emissive surface(s) or groups or surfaces. Preferably, the one or more additional power supplies are positioned electrically near the anode end of the electron multiplier since this is the region of higher signal current. The region near the anode is the high signal current region because of the accumulated increasing gain as electrons are cascaded and multiplied from one emissive surface to the next (due to secondary electron yields greater than 1.0). Alternatively, this invention can be used to provide the appropriate bias voltages across segments of a continuous dynode electron multiplier, or two (or more) continuous dynode electron multipliers used in series.

This present apparatus allows a high current to flow between the several terminal dynodes (or the terminal length of a continuous-dynode) without requiring a similar high current to flow through the voltage divider elements further up the voltage divider chain. Consequently the power requirements of the main high voltage power supply remain low and the overall power dissipated by the device is substantially reduced.

In one embodiment, separate power supplies are used to apply bias voltage differentially to the terminal electron emissive surface(s) and the remainder emissive surfaces. In such embodiments, the power supply applying bias voltage to the terminal electron emissive surface(s) is set to apply a negative bias voltage of lower magnitude compared with the power supply applying negative bias voltage to the remainder electron emissive surface(s). The lower magnitude negative bias voltage may be lower by a factor of at least about 2, 3, 4, 5, 6, 7, 8, 9, or 10.

Figure 3A:
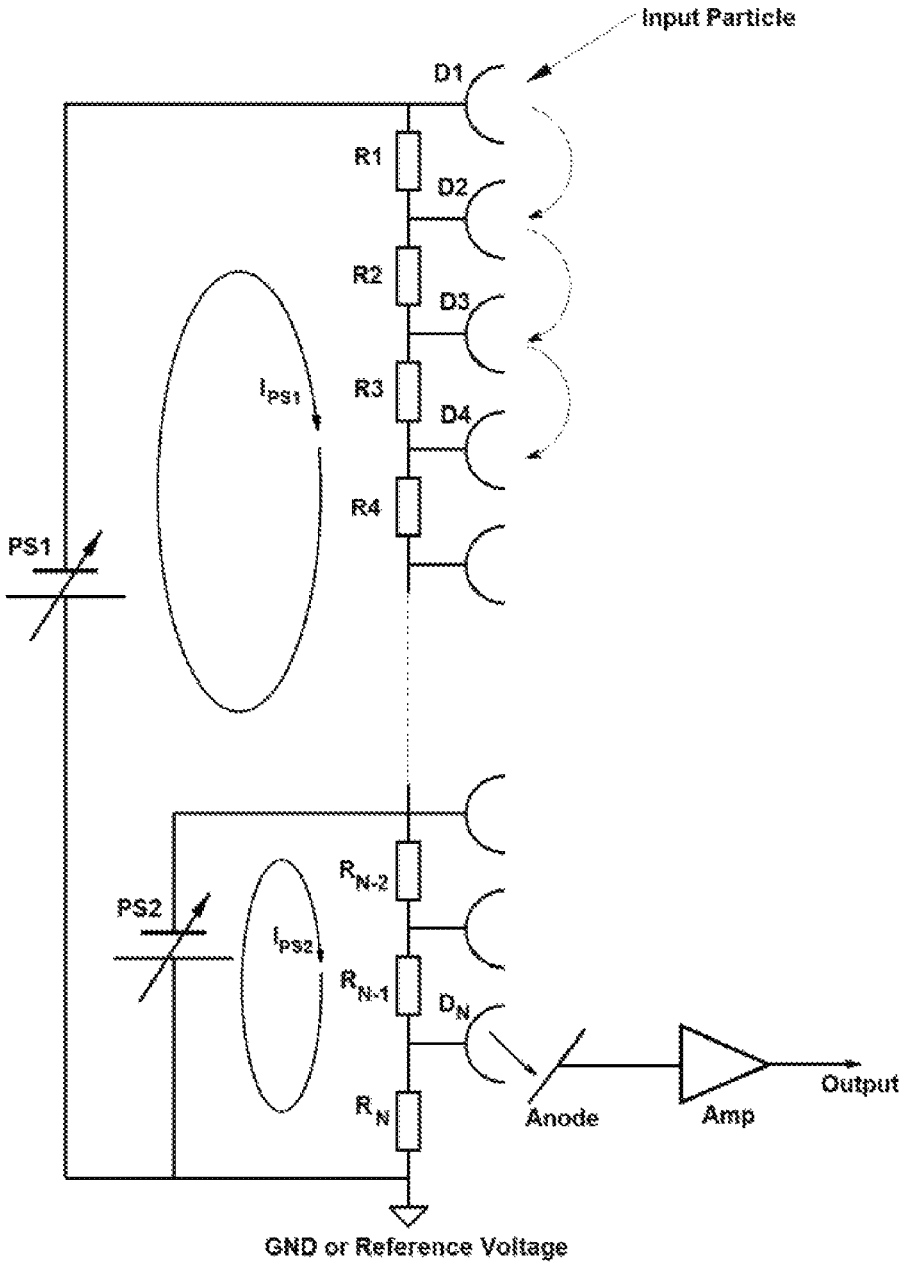
FIG. 3A is a schematic diagram of a discrete-dynode electron multiplier of the present invention. D1, D2 . . . refer to individual dynodes, R1, R2 etc refers to individual resistors, PS refers to a power supply, the curved arrows show the path of secondary electron for the first several dynodes. This embodiment comprises two powers supplies (PS1 and PS2), with PS2 applying voltage to only the three terminal dynodes. PS1 applies voltage to all other dynodes. PS1 applies a more negative bias voltage than the bias voltage applied by PS2. The circuits powered by PS1 and PS2 have bleed currents ($I_{PS1}$ and $I_{PS2}$ respectively) as indicated by the arrowed loops within the respective circuits, with $I_{PS2}$ being greater than $I_{PS1}$.
Figure 3B:
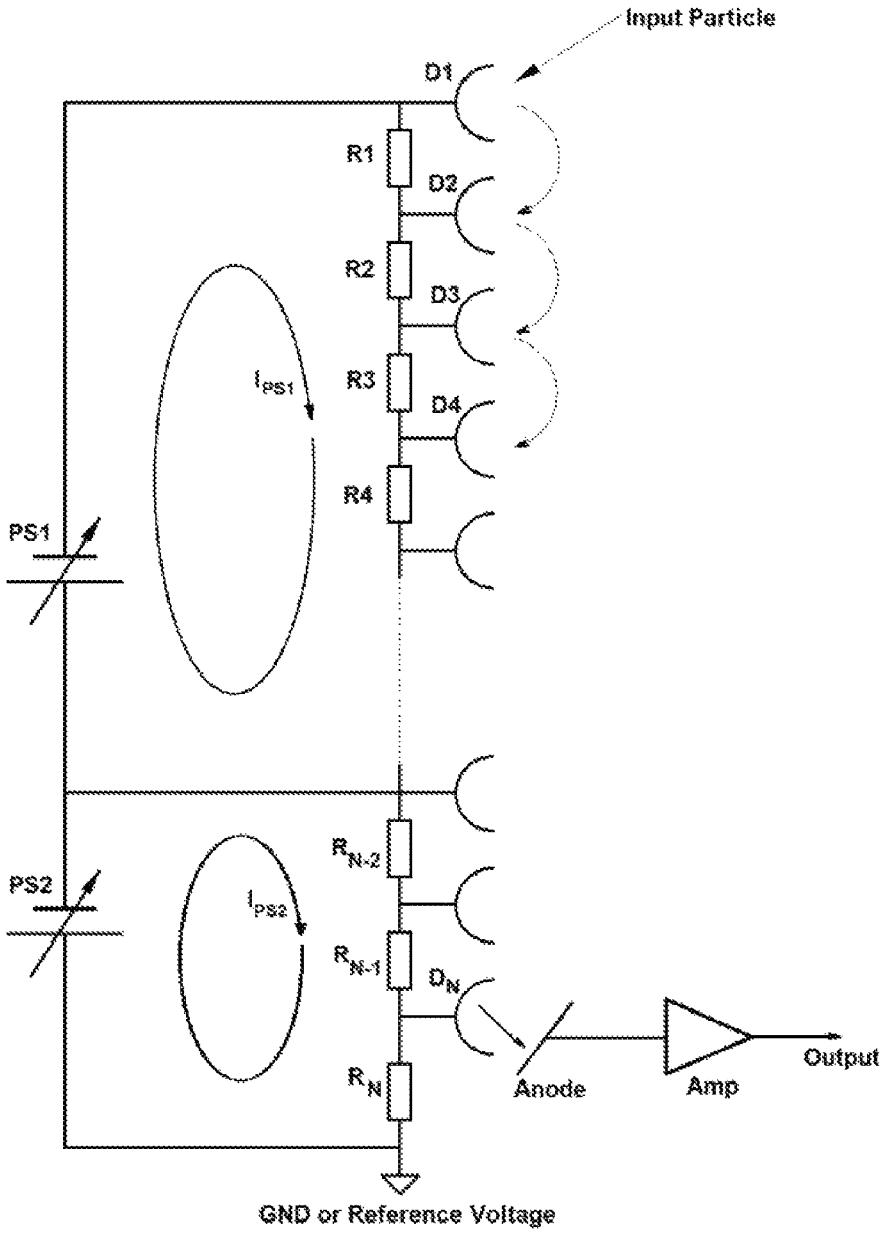
FIG. 3B is a schematic diagram of a discrete-dynode electron multiplier of the present invention, similar to that of FIG. 3A, but having an alternate method of referencing the second power supply, PS2, to the first high voltage power supply (which may also be considered the main high voltage supply), PS1.

In one embodiment and in reference to FIG. 3A, the apparatus comprises a standard high voltage power supply (HVPS) as a first power supply (PS1) configured to apply a bias voltage of about −1800V to all dynodes except for the three terminal dynodes. A lower voltage power supply (PS2) is configured to apply a bias voltage of about −400V to the three terminal electrodes. Thus, the bias voltage applied to the remainder dynodes by PS1 is more negative than the voltage applied to the terminal dynodes by PS2.

The power supplies (in this embodiment or in any other embodiment) may be of fixed voltage or adjustable voltage type. The position at which the second power supply is connected to the dynode chain may be selected according to linearity requirements of the apparatus.

In embodiments having discrete dynodes, a power supply may be configured to apply voltage to only a single dynode, or to a group of dynodes. For example, the terminal electron emissive surfaces may be defined by a group of 1, 2, 3, 4, 5 or 6 dynodes.

It should be noted that the differential currents flowing through the dynodes (as effected by the use of more than one power supply) is the important factor in achieving the advantages of the present invention. The use of separate power supplies configured to apply negative bias voltages of different magnitudes to selected dynode(s) is one means of achieving the differential currents. Advantageously, in some embodiments the use of multiple power supplies negates the need for a power supply of stringent specification, as is typically used in prior art electron multipliers.

In embodiments having a continuous dynode, a power supply may be configured to apply a voltage to a length of the dynode. In such embodiments, the positive side of the supply is connected to one border of the length of dynode, and the negative side of the supply to the opposing border.

Where two power supplies are used, all components (the power supplies and all electron emissive surfaces) are typically in electrical connection, with no means for electrically isolating a component or group of components being used. However, for the avoidance of doubt the present invention may be embodied in a kit of parts with components not in electrical connection.

A power supply may be configured to apply voltage directly to an electron emissive surface, however more typically the voltage is applied across several electron emissive surfaces. For example, where three dynodes are powered by a power supply, the positive terminal of the power supply is connected to the first dynode and the negative terminal to the third dynode with the second dynode connected in between the first and third dynodes. By this arrangement, the three dynodes are connected in series.

A voltage divider chain is generally used to distribute voltage from the power supply to the dynodes. The divider chain may comprise a series of resistors disposed between the dynodes. The voltage divider chain may be purely passive, composed of resistive elements only, or it may contain components active in voltage regulation such as zener diodes or transistors. For example, in place of the last resistor, $R_N$, in FIGS. 4A and 4B, or in place of the resistor R in FIGS. 5A and 5B, or in place of $R_1$ in FIGS. 6A and 6B.

Where a terminal dynode is involved, a resistor is typically disposed between the terminal dynode and the ground or reference voltage. Alternatively, a Zener diode may be used in place of a resistor.

Figure 4A:
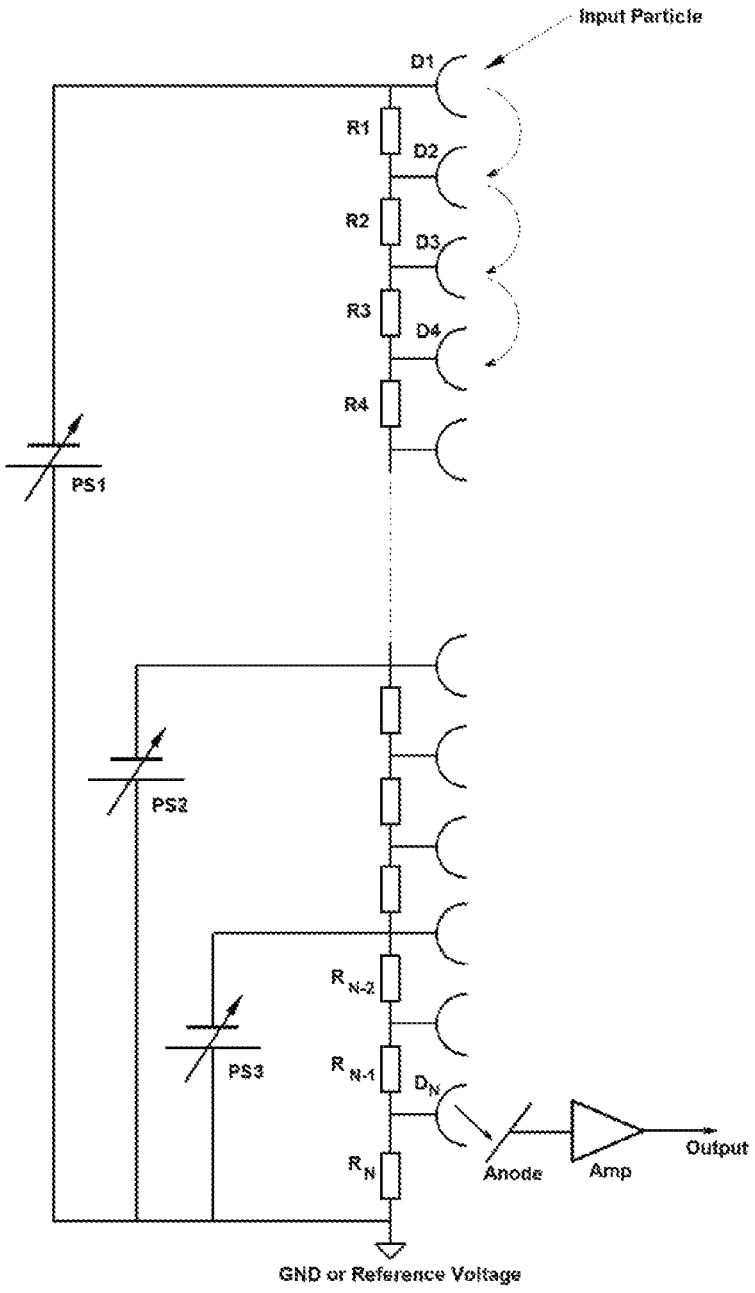
FIG. 4A is a schematic diagram of a discrete-dynode electron multiplier of the present invention, similar to that for FIG. 3A except that three power supplies are provided: PS1, PS2 and PS3. The magnitude of each negative bias voltage applied to the emissive surfaces by PS1, PS2 and PS3 are ranked as follows: PS1>PS2>PS3. The bleed current in the circuit of the second power supply, $I_{PS2}$, is greater than the bleed current flowing through the first high voltage power supply, $I_{PS1}$, and the bleed current in the circuit of the third power supply, $I_{PS3}$, is greater than $I_{PS2}$.
Figure 4B:
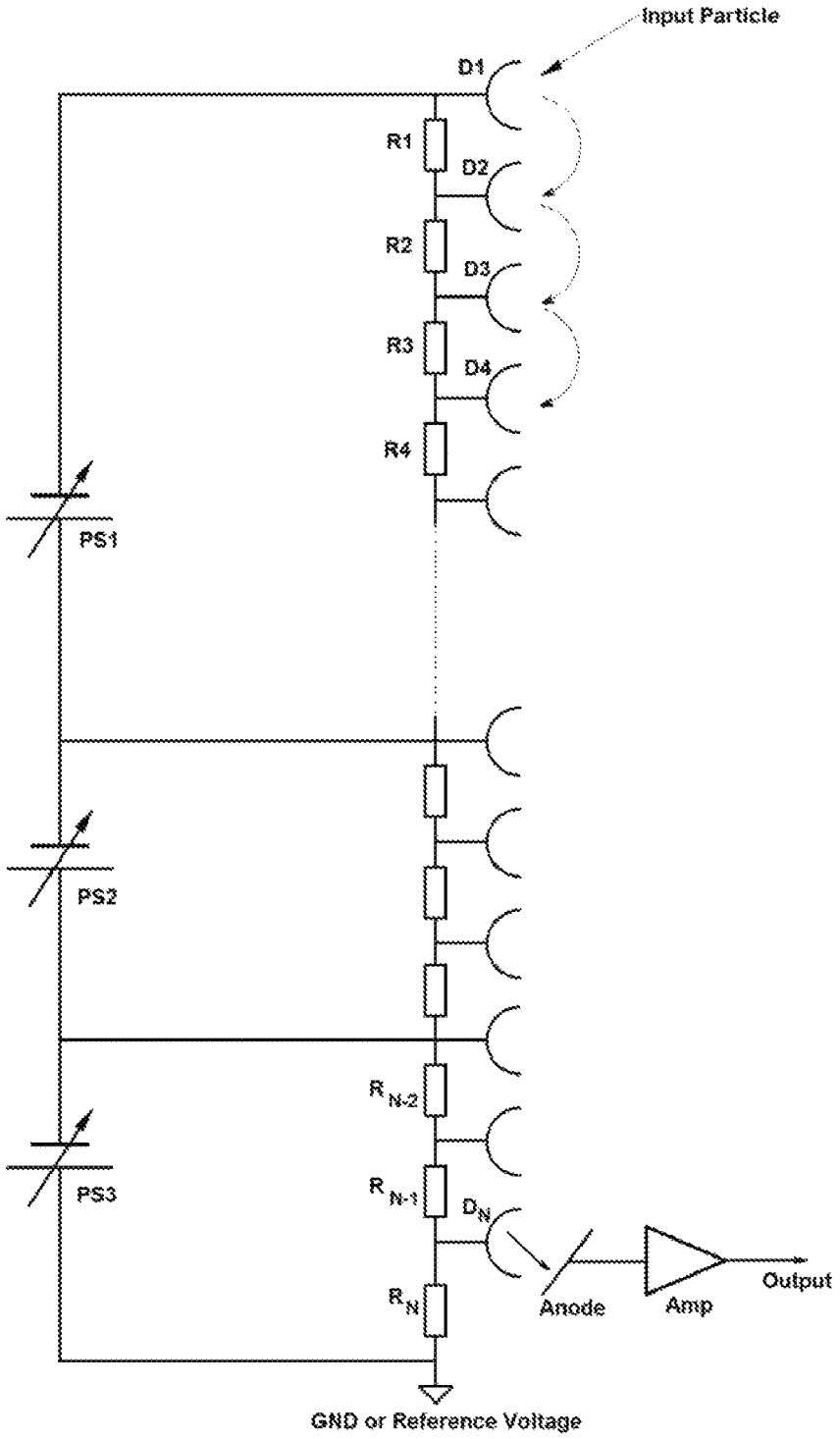
FIG. 4B is a schematic diagram of a discrete-dynode electron multiplier of the present invention, similar to that of FIG. 4A, but having an alternate method of referencing power supplies PS2 and PS3, to the main high voltage power supply, PS1.

In some embodiments more than two power supplies are used. For example, a first power supply may apply voltage to all dynodes with the exception of the six terminal dynodes. A second power supply may apply voltage to the first three dynodes of the terminal six, and a third power supply applying voltage to the last three dynodes of the terminal six. Embodiments of these forms of the invention are shown at FIGS. 4A and 4B. As shown in those figures, Power Supply 3 applies a less negative voltage than Power Supply 2, and Power Supply 1 applies a more negative voltage than Power Supply 2.

In one embodiment of a multiplier having three power supplies a bias voltage of −1800V may be applied to Power Supply 1, a bias voltage of −1100V may be applied to Power Supply 2, and a bias voltage of −400V may be applied to Power Supply 3. While in this embodiment the voltage of Power Supply 2 is set midway between Power Supply 1 and Power Supply 3, the skilled person having the benefit of the present specification is enabled to routinely investigate the effect of setting the voltage of Power Supply 2 away from the midway point.

As a broad guide, a bias of around 100V/dynode stage may be used as a starting point in setting the bias voltage.

Figure 5A:
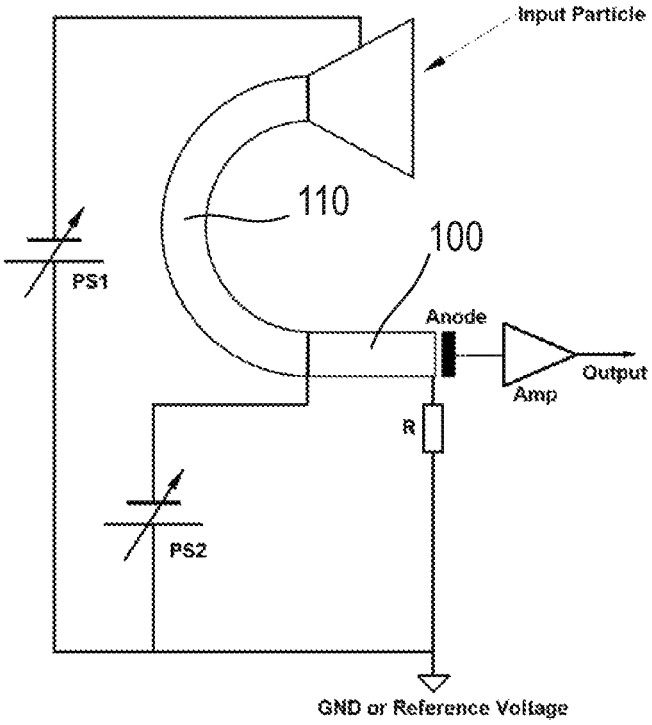
FIG. 5A is a schematic diagram of a continuous-dynode electron multiplier of the present invention. The continuous dynode is divided into a terminal portion and a remainder portion, the respective portions powered by separate power supplies PS2 and PS1 respectively. The negative bias voltage applied to the terminal portion by PS2 is more positive (or less negative) than that applied to the remainder portion by PS1.
Figure 5B:
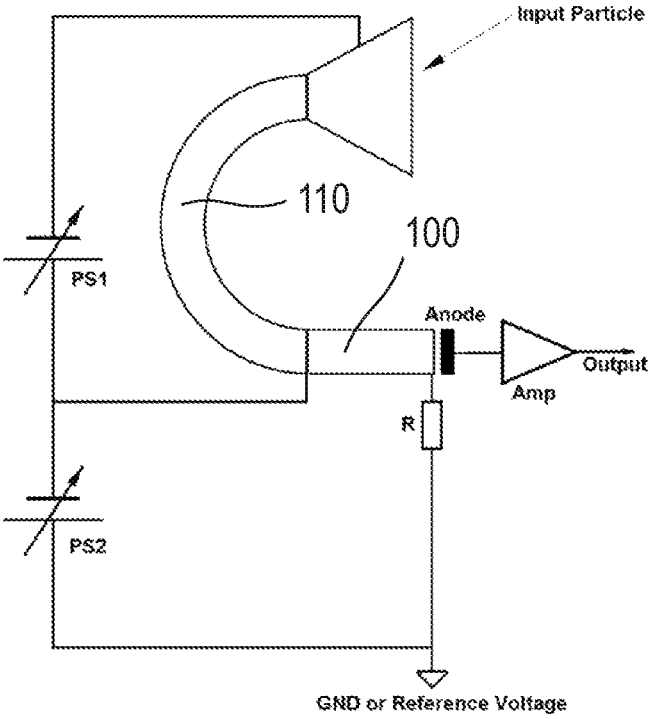
FIG. 5B is a schematic diagram of a continuous-dynode electron multiplier of the present invention, similar to that of FIG. 5A, but having an alternate method of referencing the second power supply, PS2, to the first high voltage power supply, PS1.

Turning now to preferred embodiments of the invention in the form of a continuous-dynode, reference is made to FIGS. 5A and 5B showing a version having two power supplies (PS1 and PS2). PS2 applies a less negative bias voltage across the terminal electron emissive portion 100 of the dynode, while PS1 applies a more negative bias voltage across the remainder electron emissive portion 110. The entire dynode is electrically conducting along its length, there being no electrical isolation between the portions 100 and 110.

Figure 6A:
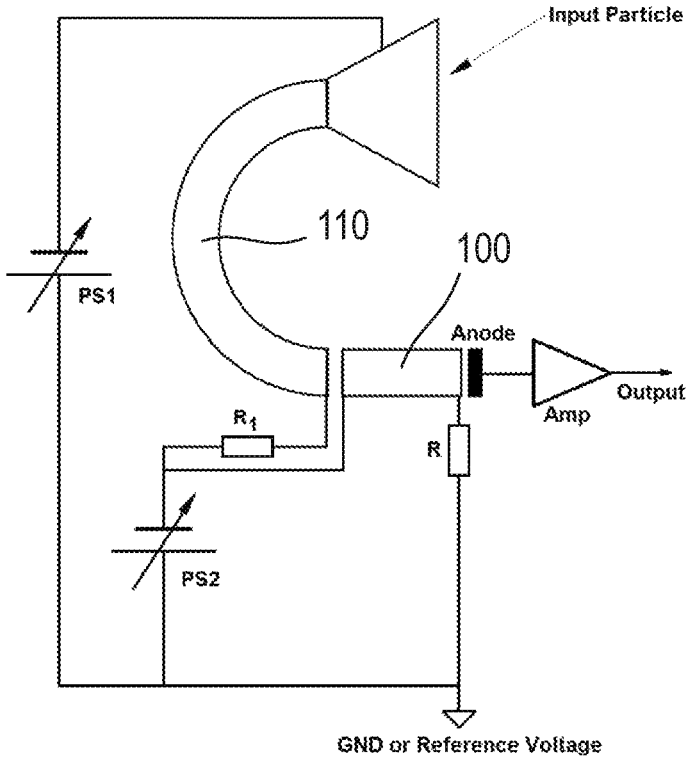
FIG. 6A is a schematic diagram of a continuous dynode divided into a terminal and a remainder portion, with the two portions being electrically discontinuous. The respective portions are powered by separate power supplies PS2 and PS1 respectively. The negative bias voltage applied to the terminal portion by PS2 is more positive (or less negative) than that applied to the remainder portion by PS1.
Figure 6B:
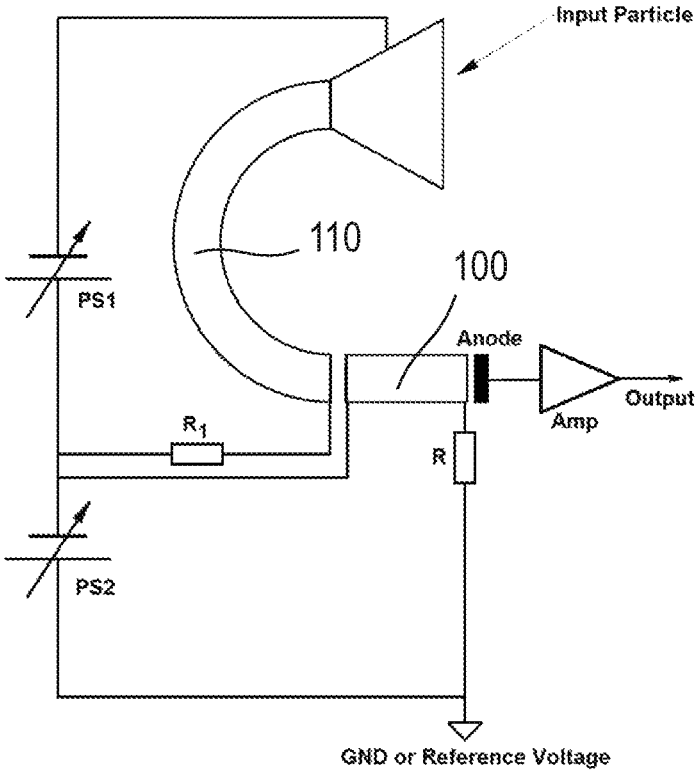
FIG. 6B is a schematic diagram of a continuous-dynode electron multiplier of the present invention, similar to that of FIG. 6A, but having an alternate method of referencing the second power supply, PS2, to the first high voltage power supply, PS1.

Implementations of alternative continuous-dynode embodiments are shown in FIGS. 6A and 6B where two portions of a continuous-dynode are each connected to separate powers supplies (PS1 and PS2). A voltage difference exists between the two portions due to the presence of resistor R1. The portion 100 is considered the terminal electron emissive surface, and the portion 110 the remainder portion.

The present invention further provides methods for electron amplification by use of the apparatus described herein. Given the benefit of the present specification, the skilled person is enabled to apply the required bias voltage(s) to the various electron emissive surfaces so as to cause amplification of an input signal. Furthermore, by routine experimentation the bias voltage(s) may be adjusted so as to improve linearity of the apparatus in response to an input particle. Where multiple power supplies are provided, multiple parametric studies may be routinely conducted so as to provide a required characteristic of the output signal.

Figure 7:
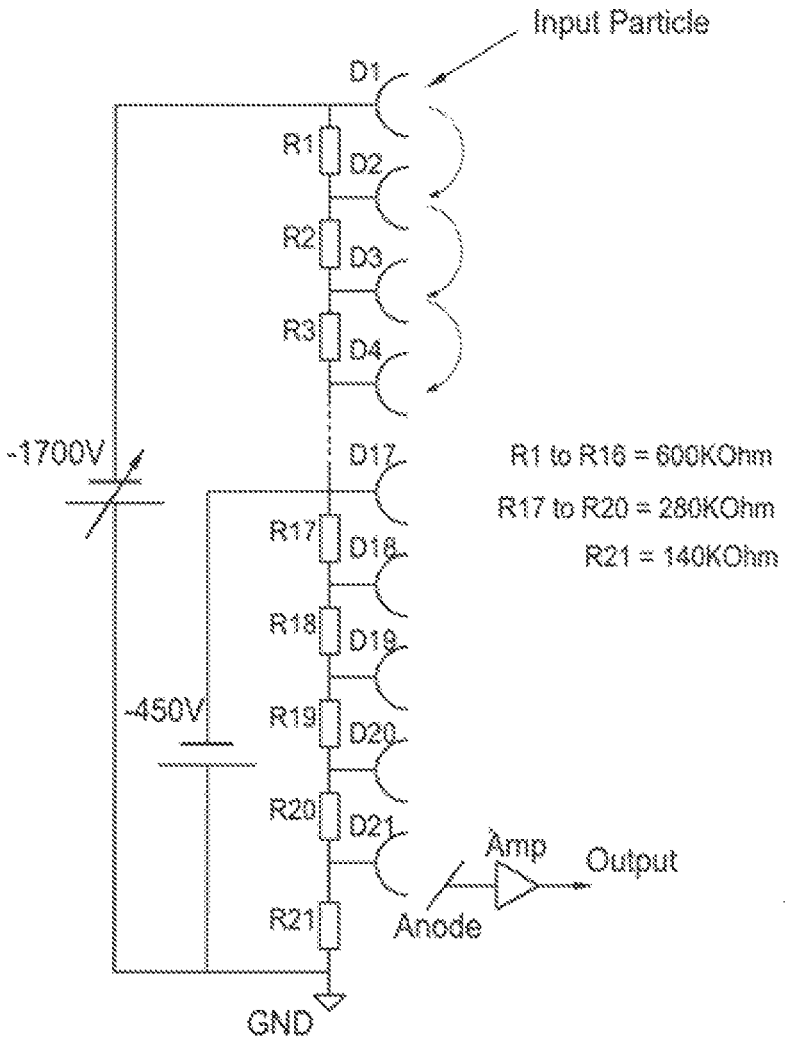
FIG. 7 is a schematic diagram of a highly preferred discrete-dynode electron multiplier of the present invention, having 21 dynodes. This embodiment (and two variations thereof) were tested for linearity the results shown graphically in FIG. 8.

Reference is now made to FIG. 7 which shows a highly preferred embodiment of the present invention. The embodiment of FIG. 7 is a 21-dynode multiplier having main (first) power supply applying a bias of −1700V, and a second power supply applying a bias of −450V across the five terminal dynodes (D17 to D21). The value of each resistor R1 to R16 is 600 KOhm, R17 to R20 are each 280 KOhm, and R21 is 140 KOhm.

The linearity of response of the electron multiplier of FIG. 7 was tested (i.e. with D17 being connected to the second power supply). Linearity was also tested with the second power supply connected to D19 (the second power supply set to apply a bias of −250V) and D21 (the second power supply set to apply a bias of −50V). In all three cases, the multiplier was operated at a gain of about 1 e6.

Table 1 below shows the results of testing for each of the three multiplier configurations.

TABLE 1

| Dynode for connection of 2nd power supply | Voltage of 2nd power supply | Voltage of 1st power supply (to give gain = 1e6) | Maximum output at 10% linearity |
|---|---|---|---|
| 17 | −450 | 1697 | 190 uA |
| 19 | −250 | 1680 | 90 uA |
| 21 | −50 | 1655 | 45 uA |

Figure 8:
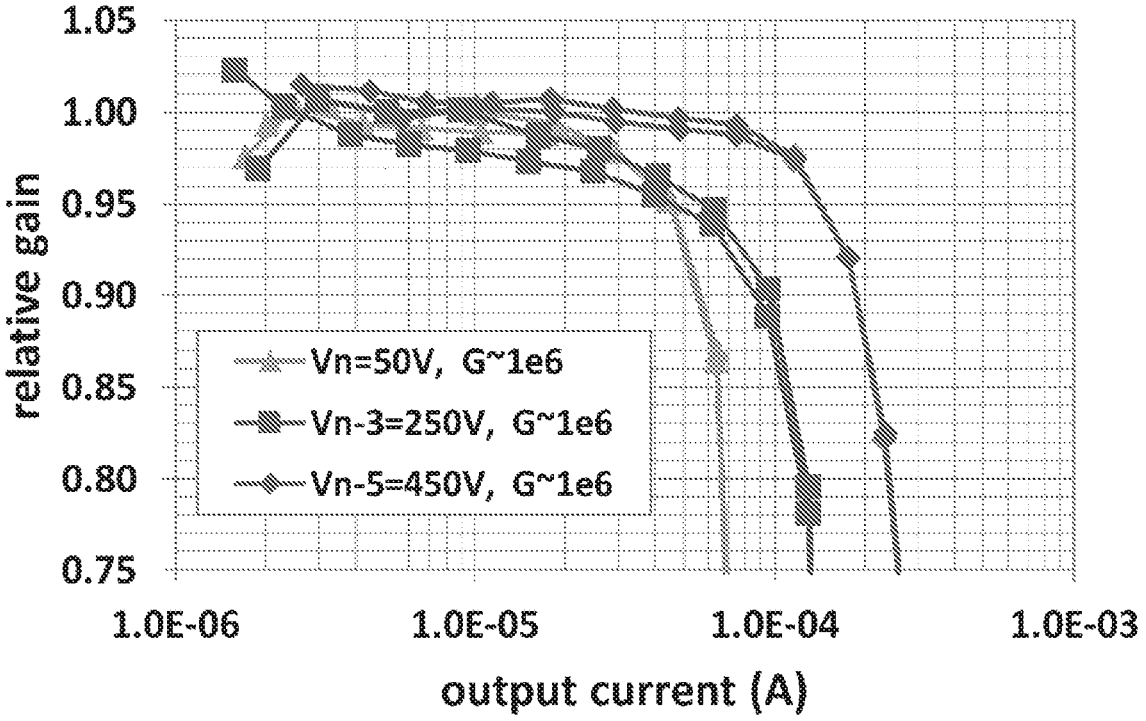
FIG. 8 is a graph showing the result of linearity testing of the electron multiplier of FIG. 7, and two variations thereof.

Reference is made to FIG. 8 which shows graphically the linearity of the 21 dynode electron multiplier with the second power supply connected alternately to D17, D19 or D21.

The detector with the power supply connected into the last dynode is the 'baseline' detector. The linearity trend shown by the tests confirms that the higher in the dynode chain that the second power supply is connected, the higher the linearity.

It will be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. Functionality may be added or deleted from the diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

The invention claimed is:

1. An ion detector comprising an apparatus for amplifying an electron signal caused by impact of an ion with an electron emissive surface, the apparatus comprising:

a first electron emissive surface configured to receive an input ion and thereby emit one or more secondary electrons, a series of second and subsequent electron emissive surfaces configured to form an amplified electron signal from the one or more secondary electrons emitted by the first electron emissive surface, and one or more power supplies configured to apply bias voltage(s) to one or more of the series of second and subsequent electron emissive surfaces, the bias voltage(s) being sufficient to form the amplified electron signal, wherein the apparatus is configured such that in response to the ion detector receiving input ions, a terminal electron emissive surface or a group of terminal electron emissive surfaces of the series of second and subsequent electron emissive surfaces are allowed to draw an electrical current at least 10-fold higher than that of a remainder of the series of second and subsequent electron emissive surface(s) so as to provide a more linear output for the ion detector as compared to the same ion detector but configured to allow for a less than 10-fold current differential.

2. The ion detector of claim 1 comprising a first power supply and at least a second power supply, each of which is configured to independently apply a bias voltage to (i) a different electron emissive surface, and/or (ii) a different group of electron emissive surfaces.

3. The ion detector of claim 2, further comprising a third, fourth, or fifth power supply, wherein each of the first, second, third, fourth or fifth power supply is configured to apply a bias voltage to a different electron emissive surface, or group of different emissive surfaces.

4. The ion detector of claim 2, wherein the bias voltages are applied according to the following:

the least negative bias voltage is applied to the most terminal emissive surface or group of emissive surfaces, the second least negative bias voltage is applied to the second most terminal emissive surface or group of emissive surfaces, the third least negative bias voltage (where present) is applied to the third most terminal emissive surface or group of emissive surfaces (where present), the fourth least negative bias voltage (where present) is applied to the fourth most terminal emissive surface or group of emissive surfaces (where present), and the fifth least negative bias voltage (where present) is applied to the fifth most terminal emissive surface or group of emissive surfaces (where present).

5. The ion detector of claim 2, wherein each circuit powered by each of the power supplies has a bleed current, and the bleed current of the electrical circuit powered by the second power supply is higher than the bleed current of the electrical circuit powered by the first power supply.

6. The ion detector of claim 5, wherein the bleed currents are according to the following:

the first highest bleed current is in the circuit comprising the most terminal emissive surface or group of emissive surfaces, the second highest bleed current is in the circuit comprising the second most terminal emissive surface or group of emissive surfaces, the third highest bleed current (where present) is in the circuit comprising the third most terminal emissive surface or group of emissive surfaces (where present), the fourth highest bleed current (where present) is in the circuit comprising the fourth most terminal emissive surface or group of emissive surfaces (where present), and the fifth highest bleed current (where present) is in the circuit comprising the fifth most terminal emissive surface or group of emissive surfaces (where present).

7. The ion detector of claim 2, wherein the second power supply, or any one or more of the third, fourth or fifth power supplies (where present) is/are electrically connected in the series of electron emissive surfaces such that the gain of the apparatus is more linear, or linear over a greater operational range, as compared with an identical apparatus having at least one less power supply.

8. The ion detector apparatus of claim 1, wherein at least two of the emissive surfaces are discrete emissive surfaces.

9. The ion detector apparatus of claim 8, wherein the discrete emissive surfaces are discrete dynodes.

10. The ion detector of claim 8, wherein the second power supply is configured to apply a bias voltage to only the terminal 12, 11, 10, 9, 8, 7, 6, 5, 4, 3, 2 or 1 discrete emissive surfaces, and the first power supply is configured to apply a bias voltage to only the remainder discrete emissive surfaces.

11. The ion detector apparatus of claim 1, wherein each of the emissive surfaces are discrete emissive surfaces.

12. The ion detector apparatus of claim 1, wherein at least one of the emissive surfaces is a continuous emissive surface.

13. The ion detector apparatus of claim 12, wherein the continuous emissive surface is a continuous dynode.

14. The ion detector of claim 12, wherein the second power supply is configured to apply a bias voltage to the terminal about 50%, 45%, 40%, 35%, 30%, 25%, 20%, 15%, 10%, or 5% of the emissive surface, and the first power supply is configured to apply a bias voltage to a remainder portion of the emissive surface.

15. A method for amplifying an electron signal caused by an impact of an ion with an electron emissive surface, the method comprising:

providing an apparatus comprising:

a first electron emissive surface configured to receive an ion and thereby emit one or more secondary electrons, a series of second and subsequent electron emissive surfaces configured to form an amplified electron signal from the one or more secondary electrons emitted by the first electron emissive surface, and one or more power supplies configured to apply bias voltage(s) to one or more of the series of second and subsequent electron emissive surfaces, the bias voltage(s) being sufficient to form the amplified electron signal, wherein the apparatus is configured such that in response to the ion detector receiving input ions, a terminal electron emissive surface(s) or a group of terminal electron emissive surfaces of the series of second and subsequent electron emissive surfaces are allowed to draw an electrical current at least 10-fold higher than that of a remainder of the series of second and subsequent electron emissive surface(s) so as to provide a more linear output for the ion detector as compared to the same ion detector but configured to allow for a less than 10-fold current differential, causing or allowing an ion to impact the first electron emissive surface, and applying bias voltage(s) to one or more of the emissive surfaces, the bias voltage(s) being sufficient to form the amplified electron signal.

* * * * *